US010862195B2

(12) United States Patent
Ouyang et al.

(10) Patent No.: US 10,862,195 B2
(45) Date of Patent: Dec. 8, 2020

(54) ELECTRONIC DEVICES WITH MILLIMETER WAVE ANTENNAS AND METAL HOUSINGS

(71) Applicant: Apple Inc., Cupertino, CA (US)

(72) Inventors: Yuehui Ouyang, Sunnyvale, CA (US); Yi Jiang, Cupertino, CA (US); Matthew A. Mow, Los Altos, CA (US); Mattia Pascolini, San Francisco, CA (US); Ruben Caballero, San Jose, CA (US); Basim Noori, Scotts Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/357,165

(22) Filed: Mar. 18, 2019

(65) Prior Publication Data

US 2019/0214708 A1 Jul. 11, 2019

Related U.S. Application Data

(62) Division of application No. 14/883,495, filed on Oct. 14, 2015, now abandoned.

(51) Int. Cl.
*H01Q 1/24* (2006.01)
*H01Q 1/40* (2006.01)
(Continued)

(52) U.S. Cl.
CPC ..... *H01Q 1/243* (2013.01); *H01Q 1/40* (2013.01); *H01Q 1/42* (2013.01); *H01Q 21/28* (2013.01); *H01Q 9/0421* (2013.01); *H01Q 9/16* (2013.01)

(58) Field of Classification Search
CPC ..... H01Q 1/243; H01Q 21/28; H01Q 1/40; H01Q 1/42; H01Q 9/0421; H01Q 9/16
See application file for complete search history.

(56) References Cited

U.S. PATENT DOCUMENTS 5,914,693 A * 6/1999 Takei ..... H01Q 13/16 343/700 MS
5,923,296 A 7/1999 Sanzgiri et al.
(Continued)

FOREIGN PATENT DOCUMENTS

CN 101449429 A 6/2009
CN 102227036 A 10/2011
(Continued)

OTHER PUBLICATIONS

Bondarik et al., Gridded Parasitic Patch Stacked Microstrip Antenna with Beam Shift Capability for 60 GHz Band, Progress in Electromagnetics Research B, vol. 62, 319-331, 2015.

*Primary Examiner* — Dieu Hien T Duong
(74) *Attorney, Agent, or Firm* — Treyz Law Group, P.C.; G. Victor Treyz; Matthew R. Williams

(57) ABSTRACT

An electronic device may be provided with wireless circuitry. The wireless circuitry may include one or more antennas. The antennas may include millimeter wave antenna arrays. Non-millimeter-wave antennas such as cellular telephone antennas may have conductive structures separated by a dielectric gap. In a device with a metal housing, a plastic-filled slot may form the dielectric gap. The conductive structures may be slot antenna structures, inverted-F antenna structures such as an inverted-F antenna resonating element and a ground, or other antenna structures. The plastic-filled slot may serve as a millimeter wave antenna window. A millimeter wave antenna array may be mounted in alignment with the millimeter wave antenna window to transmit and receive signals through the window. Millimeter wave antenna windows may also be formed from air-filled openings in a metal housing such as audio port openings.

9 Claims, 13 Drawing Sheets

(51) Int. Cl.

| | |
|---|---|
| ***H01Q 1/42*** | (2006.01) |
| ***H01Q 21/28*** | (2006.01) |
| *H01Q 9/04* | (2006.01) |
| *H01Q 9/16* | (2006.01) |

(56) References Cited

U.S. PATENT DOCUMENTS

| | | | | |
|---|---|---|---|---|
| 6,002,367 | A * | 12/1999 | Engblom | H01Q 1/243 343/700 MS |
| 6,118,406 | A | 9/2000 | Josypenko | |
| 2008/0316121 | A1* | 12/2008 | Hobson | H01Q 13/10 343/702 |
| 2009/0153412 | A1 | 6/2009 | Chiang et al. | |
| 2010/0265161 | A1* | 10/2010 | Harrysson | H01Q 1/1271 345/2.3 |
| 2010/0321253 | A1 | 12/2010 | Ayala Vazquez et al. | |
| 2012/0098708 | A1* | 4/2012 | Takasu | H01Q 1/2266 343/702 |
| 2012/0112970 | A1 | 5/2012 | Caballero et al. | |
| 2013/0222613 | A1 | 8/2013 | Yehezkely et al. | |
| 2013/0257659 | A1 | 10/2013 | Darnell et al. | |
| 2013/0278468 | A1 | 10/2013 | Yehezkely et al. | |
| 2014/0145879 | A1* | 5/2014 | Pan | H01Q 1/20 342/371 |
| 2014/0253392 | A1 | 9/2014 | Yarga et al. | |
| 2015/0035714 | A1* | 2/2015 | Zhou | H01Q 13/106 343/767 |
| 2015/0065069 | A1 | 3/2015 | McCormack et al. | |
| 2015/0085459 | A1 | 3/2015 | Pu et al. | |
| 2015/0116169 | A1 | 4/2015 | Ying | |
| 2016/0093939 | A1* | 3/2016 | Kim | H01Q 15/006 343/720 |

FOREIGN PATENT DOCUMENTS

| | | | |
|---|---|---|---|
| CN | 102856628 | A | 1/2013 |
| CN | 104051867 | A | 9/2014 |
| CN | 104701633 | A | 6/2015 |
| EP | 2779308 | A1 | 9/2014 |
| WO | 2015023299 | A | 2/2015 |
| WO | 2015058207 | | 4/2015 |

* cited by examiner

ELECTRONIC DEVICES WITH MILLIMETER WAVE ANTENNAS AND METAL HOUSINGS

This application is a division of patent application Ser. No. 14/883,495, filed Oct. 14, 2015, which is hereby incorporated by reference herein in its entirety.

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave communications bands. Millimeter wave communications, which are sometimes referred to as extremely high frequency (EHF) communications, involve communications at frequencies of about 10-400 GHz. Operation at these frequencies may support high bandwidths, but may raise significant challenges. For example, millimeter wave communications are typically line-of-sight communications and can be characterized by substantial attenuation during signal propagation. Additional challenges arise when attempting to place millimeter wave antennas within electronic devices. Housing structures and other components in an electronic device can adversely affect antenna performance. If care is not taken, components such as metal housing components can prevent antennas from performing effectively.

It would therefore be desirable to be able to provide electronic devices with improved wireless communications circuitry such as communications circuitry that supports millimeter wave communications.

SUMMARY

An electronic device may be provided with wireless circuitry. The wireless circuitry may include one or more antennas. The antennas may include millimeter wave antenna arrays.

Non-millimeter-wave antennas such as cellular telephone antennas may have conductive structures separated by a dielectric gap. In a device with a metal housing, a plastic-filled slot or other plastic-filled opening in the metal housing may be associated with the dielectric gap.

The non-millimeter-wave antennas may be slot antennas, inverted-F antennas, or other antennas. The conductive structures for the non-millimeter-wave antennas may include portions of a ground plane containing the plastic-filled slot, may include an inverted-F antenna resonating element that is separated from an antenna ground plane by the plastic-filled slot, or may include other antenna structures.

The plastic-filled slot that is associated with the non-millimeter-wave antenna may serve as a millimeter wave antenna window. A millimeter wave antenna array may be mounted in alignment with the millimeter wave antenna window and may transmit and receive antenna signals through the window. Millimeter wave antenna windows in metal device housings may also have the shapes of logos, gaps in peripheral conductive housing structures, and other shapes.

Millimeter wave antenna windows may be formed from air-filled openings in a metal housing such as audio port openings, connector port openings, or other holes in the metal walls of an electronic device. Millimeter wave antennas may be formed from slot antennas, patch antennas, dipoles, or other antennas.

DETAILED DESCRIPTION

Figure 1:
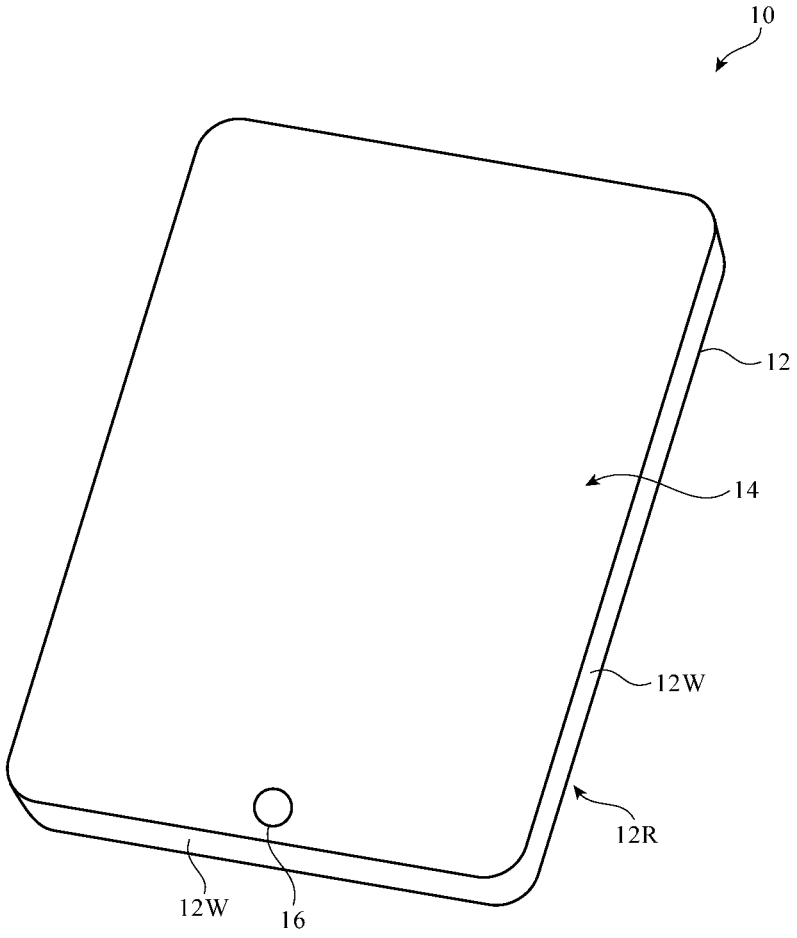
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include one or more antennas and may include phased antenna arrays. The antennas may include millimeter wave antennas that are used for handling millimeter wave communications. Millimeter wave communications, which are sometimes referred to as extremely high frequency (EHF) communications, involve signals at 60 GHz or other frequencies between about 10 GHz and 400 GHz. If desired, device 10 may also contain wireless communications circuitry for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass, clear plastic, sapphire, or other transparent dielectric. Openings may be formed in the display cover layer. For example, an opening may be formed in the display cover layer to accommodate a button such as button 16. An opening may also be formed in the display cover layer to accommodate ports such as a speaker port. Openings may be formed in housing 12 to form communications ports (e.g., an audio jack port, a digital data port, etc.). Openings in housing 12 may also be formed for audio components such as speakers and microphones. Audio ports may be formed form single openings in housing 12 or arrays of small openings (sometimes referred to a microperf openings).

Antennas may be mounted in housing 12. To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when an antenna (or set of antennas) is being adversely affected due to the orientation of housing 12, blockage by a user's hand or other external object, or other environmental factors. Device 10 can then switch an antenna (or set of antennas) into use in place of the antennas that are being adversely affected. In some configurations, antennas in device 10 may be arranged in phased arrays. Antenna arrays may use beam steering techniques to help enhance antenna performance. Extremely high frequency communications are often line-of-sight communications and can therefore benefit from beam steering techniques that help align radio-frequency signals with desired targets.

Antennas may be mounted along the peripheral edges of housing 12, on the rear of housing 12 (i.e., planar rear housing wall 12W on the rear surface of housing 12 in the example of FIG. 1), under the display cover glass or other dielectric display cover layer that is used in covering and protecting display 14 on the front surface of device 10, under a dielectric window on a rear face of housing 12 (e.g., under a dielectric logo, antenna window, or cellular telephone dielectric slot on rear wall 12W) or the edge of housing 12 (e.g., in an opening or plastic-filled window in one of housing sidewalls 12W), under air-filled openings in housing 12 (e.g., under audio port openings in housing 12 or other openings of the type that may be filled with air), or elsewhere in device 10.

Figure 2:
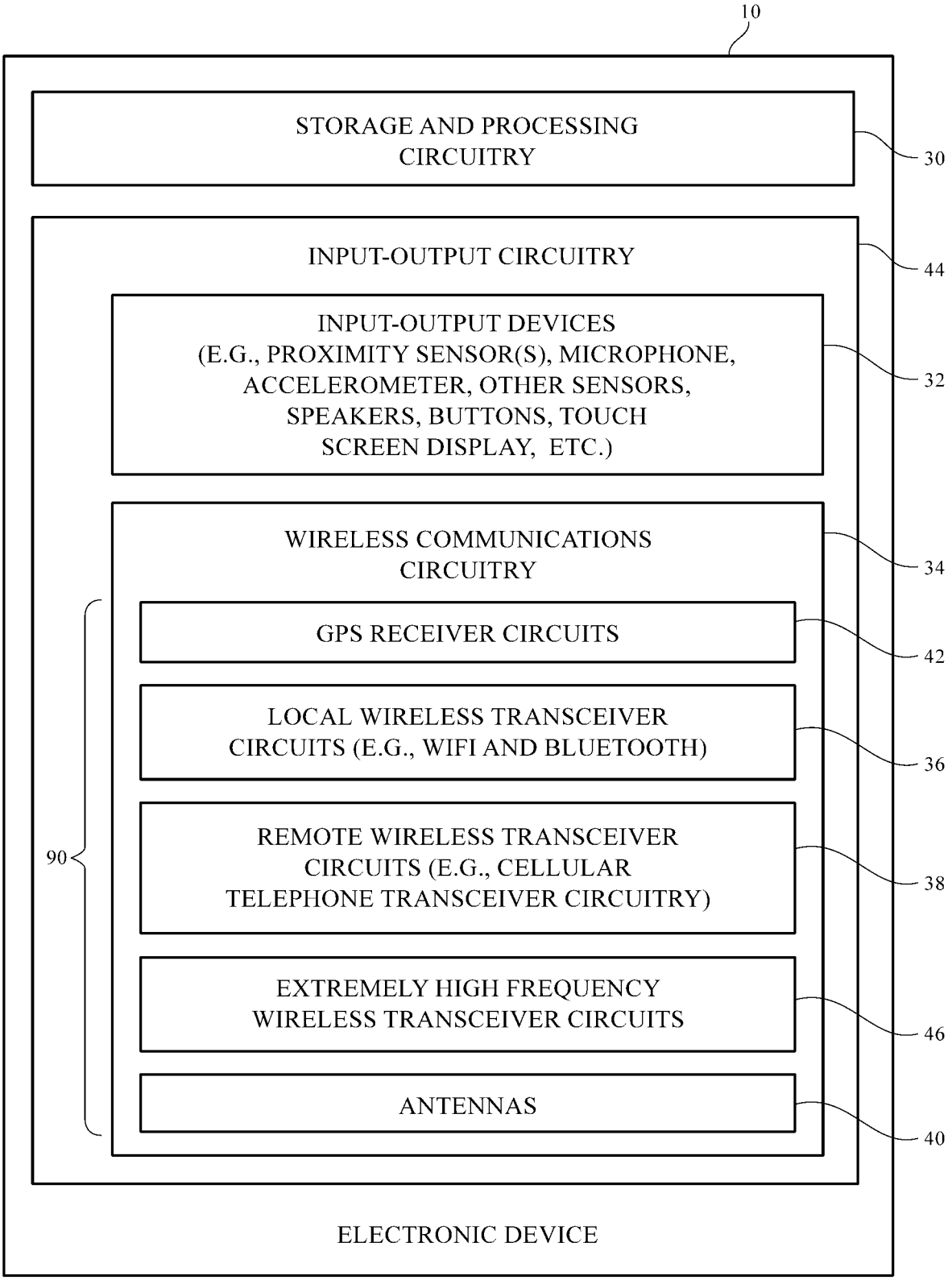
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include control circuitry such as storage and processing circuitry 30. Storage and processing circuitry 30 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 30 may be used to control the operation of device 10. This processing circuitry may be based on one or more microprocessors, microcontrollers, digital signal processors, baseband processor integrated circuits, application specific integrated circuits, etc.

Storage and processing circuitry 30 may be used to run software on device 10, such as internet browsing applications, voice-over-internet-protocol (VOIP) telephone call applications, email applications, media playback applications, operating system functions, etc. To support interactions with external equipment, storage and processing circuitry 30 may be used in implementing communications protocols. Communications protocols that may be implemented using storage and processing circuitry 30 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, satellite navigation system protocols, etc.

Device 10 may include input-output circuitry 44. Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, a connector port sensor or other sensor that determines whether device 10 is mounted in a dock, and other sensors and input-output components.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, 42, and 46.

Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band.

Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data.

Millimeter wave transceiver circuitry 46 may support communications at extremely high frequencies (e.g., millimeter wave frequencies from 10 GHz to 400 GHz or other millimeter wave frequencies).

Wireless communications circuitry 34 may include satellite navigation system circuitry such as Global Positioning System (GPS) receiver circuitry 42 for receiving GPS signals at 1575 MHz or for handling other satellite positioning data (e.g., GLONASS signals at 1609 MHz). Satellite navigation system signals for receiver 42 are received from a constellation of satellites orbiting the earth.

In satellite navigation system links, cellular telephone links, and other long-range links, wireless signals are typically used to convey data over thousands of feet or miles. In WiFi® and Bluetooth® links and other short-range wireless links, wireless signals are typically used to convey data over tens or hundreds of feet. Extremely high frequency (EHF) wireless transceiver circuitry 46 may convey signals over these short distances that travel between transmitter and receiver over a line-of-sight path. To enhance signal reception for millimeter wave communications, phased antenna arrays and beam steering techniques may be used. Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can include phased antenna arrays and other antenna structures for handling millimeter wave communications.

Transmission line paths may be used to route antenna signals within device 10. For example, transmission line paths may be used to couple antenna structures 40 to transceiver circuitry 90. Transmission lines in device 10 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within the transmission lines, if desired. In some arrangements, the use of transmission lines may be minimized by co-locating radio-frequency transceiver circuitry with antennas 40.

Device 10 may contain multiple antennas 40. The antennas may be used together or one of the antennas may be switched into use while other antenna(s) are switched out of use. If desired, control circuitry 30 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may include antenna arrays (e.g., phased antenna arrays to implement beam steering functions). For example, the antennas that are used in handling millimeter wave signals for extremely high frequency wireless transceiver circuits 46 may be implemented as phased antenna arrays. The radiating elements in a phased antenna array for supporting millimeter wave communications may be slot antennas, patch antennas, dipole antennas, or other suitable antenna elements. Transceiver circuitry can be integrated with the phased antenna arrays to form integrated phased antenna array and transceiver circuit modules.

In devices such as handheld devices, the presence of an external object such as the hand of a user or a table or other surface on which a device is resting has a potential to block wireless signals such as millimeter wave signals. Accordingly, it may be desirable to incorporate multiple phased antenna arrays into device 10, each of which is placed in a different location within device 10. With this type of arrangement, an unblocked phased antenna array may be switched into use and, once switched into use, the phased antenna array may use beam steering to optimize wireless performance. Configurations in which antennas from one or more different locations in device 10 are operated together may also be used (e.g., to form a phased antenna array, etc.).

Conductive structures in device 10 such as portions of display 14, printed circuit traces, metal internal housing features (e.g., mounting brackets), metal in electrical components such as integrated circuits, speaker coils, button conductors, and other electrical component structures, and metal housing walls in housing 12 may affect antenna performance. To accommodate antennas in a device that incorporates metal structures such as these (e.g., metal housing structures), it may be desirable to form dielectric openings in a metal housing. Configurations in which housing 12 is formed from metal and has one or more dielectric openings to accommodate antennas 40 and/or parts of antennas 40 may sometimes be described herein as an example. If desired, all or part of housing 12 may be formed from glass, plastic, or other dielectric material that does not substantially interfere with the operation of underlying antennas. The use of metal housings 12 is merely illustrative.

Antenna windows in metal housing 12 may be formed from openings in metal housing 12 that are filled with dielectric. The dielectric may be gaseous (e.g., air) or may be solid (e.g., plastic, glass, ceramic, etc.). Plastic-filled antenna windows may be used in configurations in which it is desired to form a housing structure that prevents intrusion of environmental contaminants such as dust and moisture. Air-filled antenna windows may be used in configurations in which it is desired to allow sound to pass through the antenna window (e.g., in the context of an audio port such as a speaker port or microphone port) and in configurations in which it is desired to allow air to flow (e.g., in ventilation ports such as intake and exhaust ports in a ventilation system for a laptop computer or other device).

It is often desirable to provide device 10 with antennas to cover different communications bands. The antennas used in handling some types of signals may have different sizes than the antennas using other types of signals. For example, cellular telephone and wireless local area network antennas such as WiFi® antennas may have dimensions on the order of centimeters (e.g., 1-5 cm, more than 1 cm, less than 10 cm, etc.), whereas millimeter wave antennas may have smaller dimensions (e.g., a fraction of a millimeter, more than 0.05 mm, 0.1 mm to 2 mm, less than 2 mm, less than 1 mm, etc.). The differences in scale between these different types of antennas can be exploited when integrating millimeter wave antennas within an electronic device with a metal housing.

As an example, a cellular telephone antenna in metal housing 12 may have an inverted-F antenna construction. The antenna may use an elongated plastic-filled slot in metal housing 12 to separate an inverted-F antenna resonating element (e.g., a peripheral conductive portion of housing 12 such as a segment of sidewall 12W) from a larger rectangular housing structure (e.g., rear wall 12R) that serves as an antenna ground. The plastic-filled slot may have a length of several centimeters or more and a width of 0.5-2 mm (or other size greater than 0.5 mm, greater than 1 mm, less than 8 mm, etc.). The size of the cellular telephone slot may be sufficient to serve both as a dielectric gap between the antenna's ground plane and the inverted-F resonating element in the cellular telephone antenna and as a plastic-filled millimeter wave antenna window for an array of millimeter wave antennas. Similarly, a cellular telephone slot antenna may have a plastic filled slot in a metal housing wall. The plastic-filled slot in this situation can also serve as a millimeter wave antenna window for an array of millimeter wave antennas. Millimeter wave antenna windows may also be formed from dielectric gaps in hybrid slot-inverted-F antennas.

FIGS. 3, 4, 5, 6, 7, and 8 show illustrative locations at which antenna arrays for millimeter wave communications may be located in device 10. Housing 12 may be formed from a conductive material such as metal. Openings may be formed in the metal of housing 12. These openings may be filled with plastic and/or may be left open to the air. These openings may serve to separate conductive structures from each other in a cellular telephone antenna or other larger wavelength antenna and may serve as an antenna window for one or more millimeter wave antennas.

Figure 3:
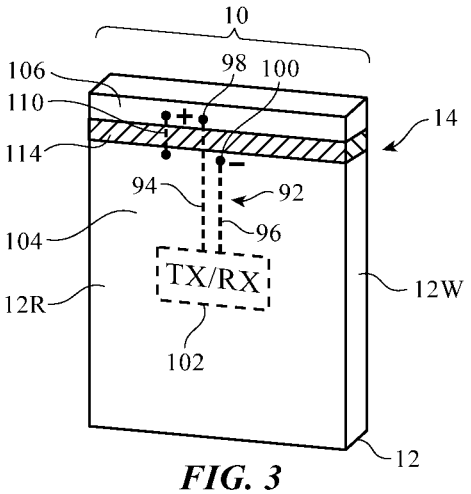
FIGS. 3, 4, 5, 6, 7, and 8 are perspective views of illustrative electronic devices showing illustrative locations at which antenna arrays for millimeter wave communications may be located in accordance with embodiments.

In the illustrative configuration of FIG. 3, a cellular telephone slot antenna (and/or WiFi® antenna) is an inverted-F antenna that is being formed using a plastic-filled slot (opening 114) in metal housing wall 12R. Slot 114 extends across rear metal housing wall 12R and down the left and right edges of walls 12W, thereby separating a peripheral portion of the conductive housing structures of device 10 along the upper edge of housing 12 from the main portion of rear wall 12W. The separated portion of the peripheral conductive housing structures forms a conductive metal segment running along at least some of the peripheral edges of device 10 and serves as inverted-F antenna resonating element 106 (in this example). Slot 114 separates element 106 from rear metal wall 12W, which serves as antenna ground for the inverted-F antenna. Return path 110 may electrically couple element 106 to ground 104 at a position along the length of slot 114 that is parallel to the antenna feed for the inverted-F antenna.

Non-millimeter-wave transceiver circuitry such as transceiver circuitry 102 may be coupled to the inverted-F antenna (and/or to other non-millimeter-wave antennas). Transceiver circuitry 102 may include non-extremely-high-frequency transceiver circuitry such as cellular telephone transceiver circuitry 38, satellite navigation system circuitry 42, and/or wireless local area network (WiFi®) transceiver circuitry 36 (as an example). Transmission line 92 may couple transceiver circuitry 102 to a feed for the inverted-F antenna. Transmission line 92 may include positive transmission line conductor 94 coupled to positive antenna feed terminal 98 and ground transmission line conductor 96 coupled to ground antenna feed terminal 100.

Figure 4:
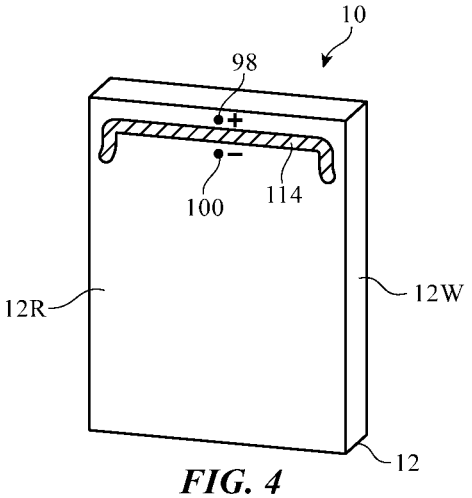
Figure 5:
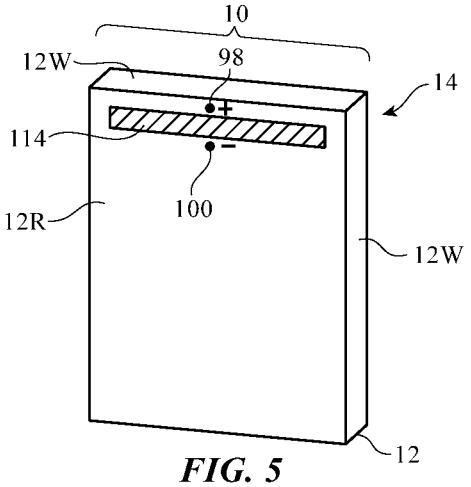
Figure 6:
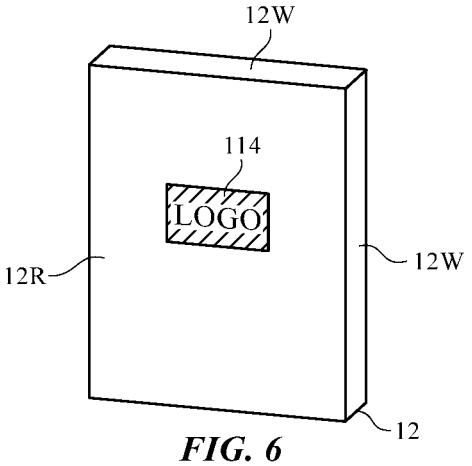
Figure 7:
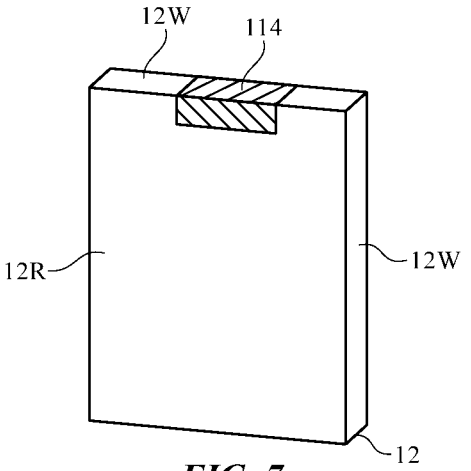
Figure 8:
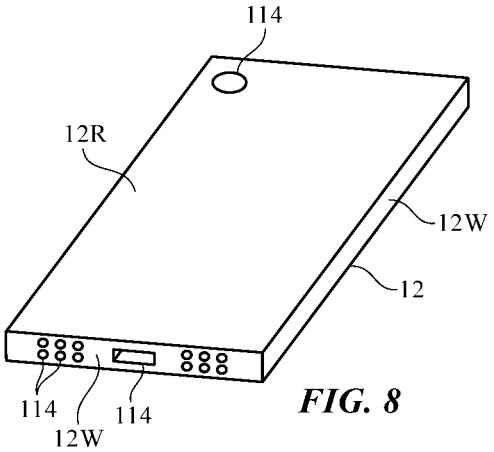

The size of opening 114 of FIG. 3 may be sufficient to allow opening 114 to serve as a millimeter wave antenna window in metal housing 12. If desired, millimeter wave antenna windows 114 may be formed from other types of plastic-filled openings (any of which may, if desired, be used in forming an inverted-F antenna, slot antenna, or other type of antenna that is coupled to transceiver circuitry 102). The example of FIG. 4 shows how millimeter wave antenna window 114 may be formed from a curved slot in rear metal housing wall 12R (e.g., a curved slot for a slot antenna, etc.). FIG. 5 is an illustrative example in which a plastic-filled opening with a straight slot shape forms millimeter wave antenna window 114. In the example of FIG. 6, millimeter wave antenna window 114 has the shape of a logo in rear wall 12R. Millimeter wave antenna window 114 may, if desired, be formed using a plastic-filled opening that extends over a portion of rear wall 12R and an adjacent portion of one of sidewalls 12W, as shown in FIG. 7. If desired, a camera window (e.g., a transparent glass or plastic disk) may be formed in rear housing wall 12R, audio port openings may be formed on sidewall 12W or other walls of housing 12, connector port openings may be formed on sidewall 12W or other walls of housing 12, or other air-filled openings may be formed in housing 12. These air-filled openings may serve as millimeter wave antenna windows 114 (see, e.g., FIG. 8).

FIGS. 9, 10, 11, and 12 are diagrams of illustrative slot antennas for device 10. Slot antennas 116 of FIGS. 9, 10, 11, and 12 may be, for example, millimeter wave slot antennas (e.g., millimeter wave slot antennas that transmit and/or receive antenna signals through dielectric portions of device 10 such as millimeter wave antenna windows 114).

Figure 9:
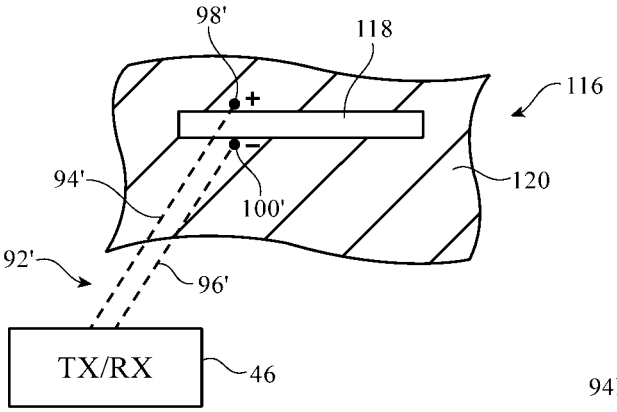
FIGS. 9, 10, 11, and 12 are perspective views of illustrative slot antenna feed structures in accordance with embodiments.

As shown in FIG. 9, millimeter wave antenna 116 may have a slot such as slot 118 in ground plane 120. Slot 118 may be filled with a gaseous dielectric such as air and/or a solid dielectric such as plastic or glass. Ground plane 120 may be formed from a metal portion of housing 12 such as a portion of a metal housing wall such as wall 12R or sidewalls 12W, metal traces on a printed circuit or other dielectric substrate, or other conductive structures in device 10. Slot antenna 116 may be fed using transmission line 92'. Transmission line 92' may include a positive signal conductor such as conductor 94' that is coupled to positive antenna feed 98' and a ground signal conductor such as conductor 96' that is coupled to ground antenna feed 100'. Millimeter wave transceiver circuitry 46 may be coupled to the antenna feed for slot antenna 116 that is formed from terminals 98' and 100' using transmission line 92'.

Figure 10:
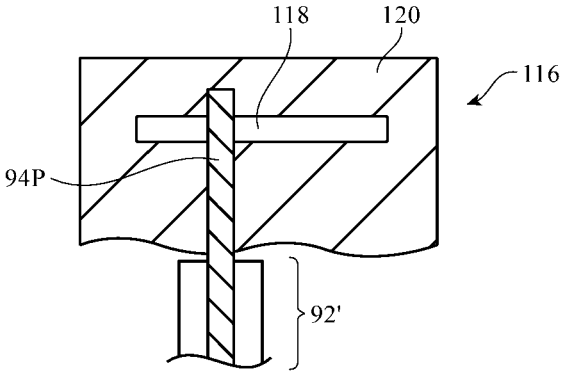
Figure 11:
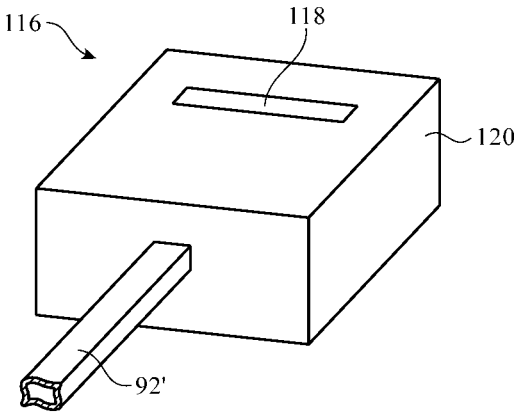

As shown in FIG. 10, slot antenna 116 may be fed using a coupled feed arrangement (e.g., an arrangement in which a portion of a transmission line conductor such as portion 94P overlaps slot 118 in ground 120). FIG. 11 shows how transmission line 92' may be formed from a hollow waveguide and shows how slot antenna 116 may be formed by incorporating slot 118 into one of the metal sides of a hollow ground structure that serves as an antenna cavity.

Figure 12:
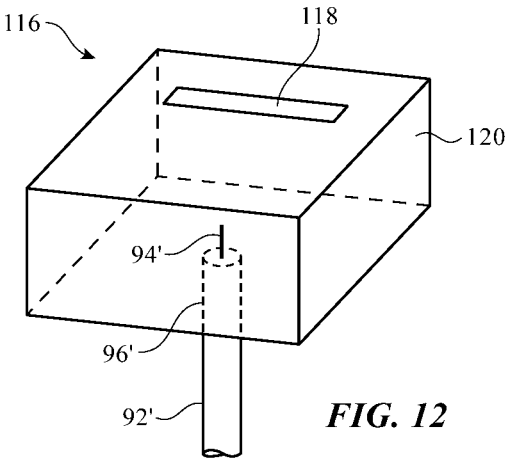
Figure 13:
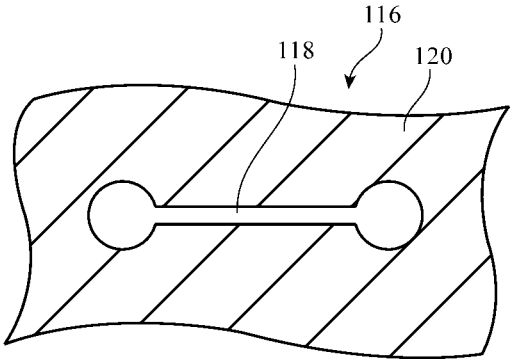
FIGS. 13, 14, 15, and 16 are top views of illustrative slot antennas in accordance with embodiments.

Another illustrative cavity-backed antenna configuration for slot antenna 116 is shown in FIG. 12. In the example of FIG. 12, cavity 120 is being fed using a probe formed from an extended portion of conductor 94' that protrudes from within transmission line 92' (e.g., a coaxial cable) in the interior of cavity 120.

Figure 14:
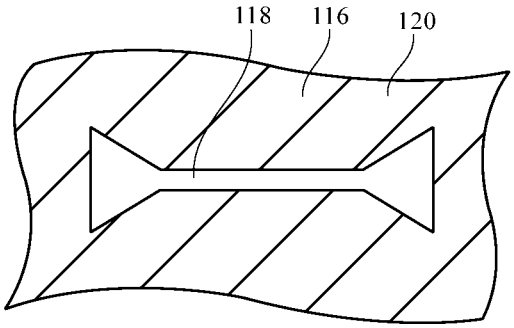
Figure 15:
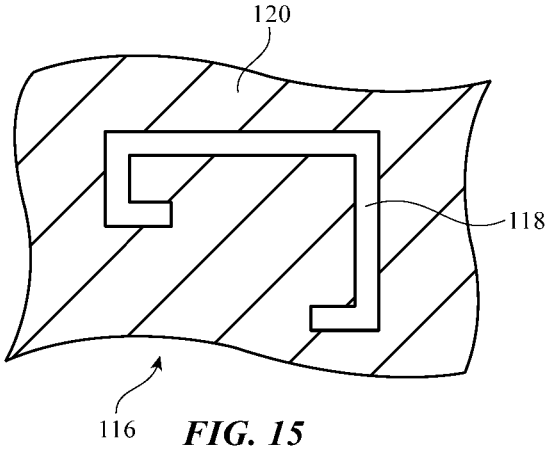
Figure 16:
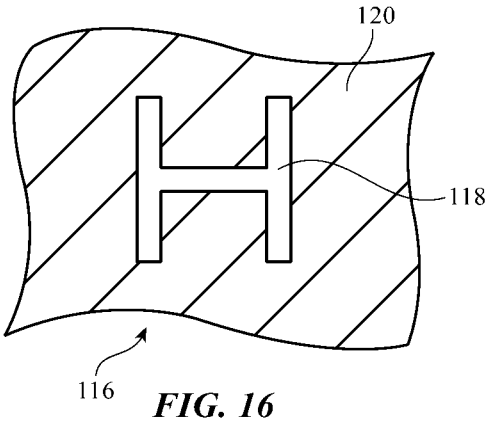

FIGS. 13, 14, 15, and 16 are top views of illustrative configurations for slot antenna 116 in which slot 118 has different shapes. In the example FIG. 13, slot 118 has a barbell shape. FIG. 14 shows how slot 118 may have opposing ends with enlarged triangular openings. In the example of FIG. 15, slot 118 has a meandering shape. In the FIG. 16 example, slot 118 has an "H" shape. Other shapes and sizes may be used for slot 118 in slot antenna 116. The examples of FIGS. 13, 14, 15, and 16 are merely illustrative.

Figure 17:
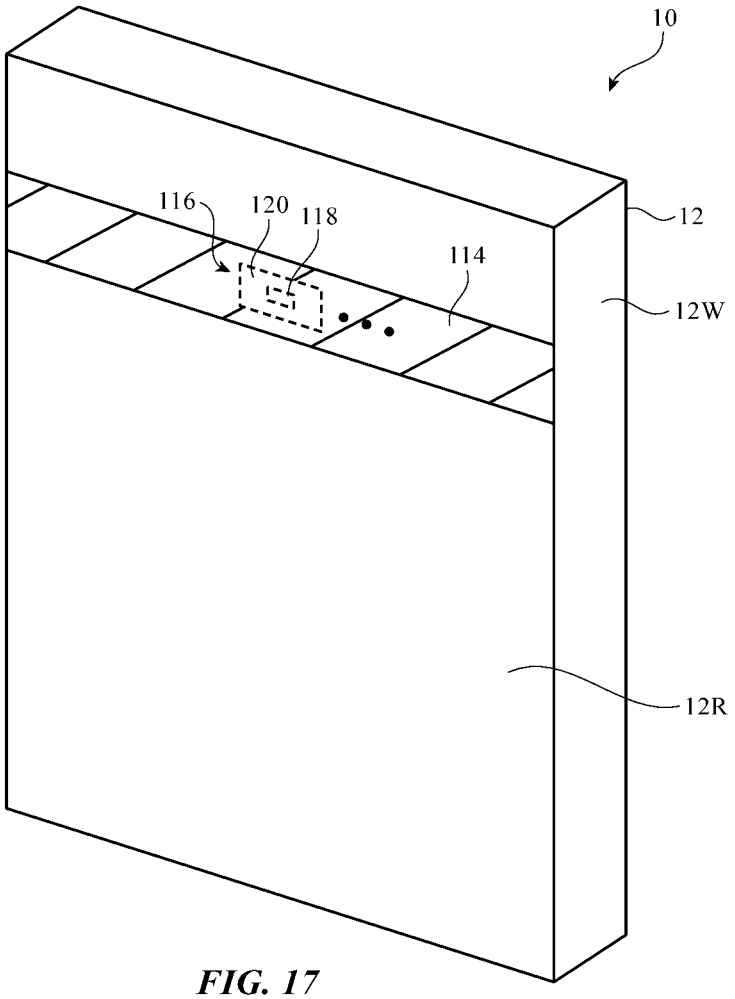
FIG. 17 is a perspective view of an illustrative electronic device with a slot antenna aligned with a dielectric slot in a metal electronic device housing in accordance with an embodiment.
Figure 18:
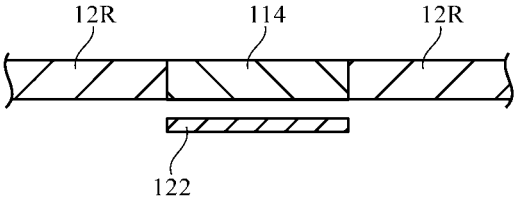
FIG. 18 is a cross-sectional side view of an illustrative patch antenna aligned with a dielectric slot of the type shown in FIG. 17 in accordance with an embodiment.
Figure 19:
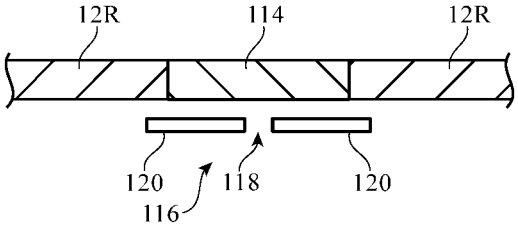
FIG. 19 is a cross-sectional side view of an illustrative slot antenna aligned with the dielectric slot of the type shown in FIG. 17 in accordance with an embodiment.

FIG. 17 is a perspective view of an illustrative electronic device with a slot antenna. As shown in FIG. 17, one or more slot antennas such as slot antenna 116 may be mounted in alignment with millimeter wave antenna window 114 in metal housing 12. Cross-sectional side views of a millimeter wave antenna window such as window 114 in metal housing wall 12R are shown in FIGS. 18 and 19. In the example of FIG. 18, patch antenna resonating element 122 has been aligned with window 114. In the example of FIG. 19, slot antenna 116 has been aligned with window 114 so that signals may be transmitted and received through window 114. As shown in FIG. 19, the width of slot 118 (e.g., about 0.2 mm) may be less than the width of window 114 (e.g., about 0.8 mm), which allows millimeter wave slot antenna 116 of FIG. 19 operate efficiently.

Figure 20:
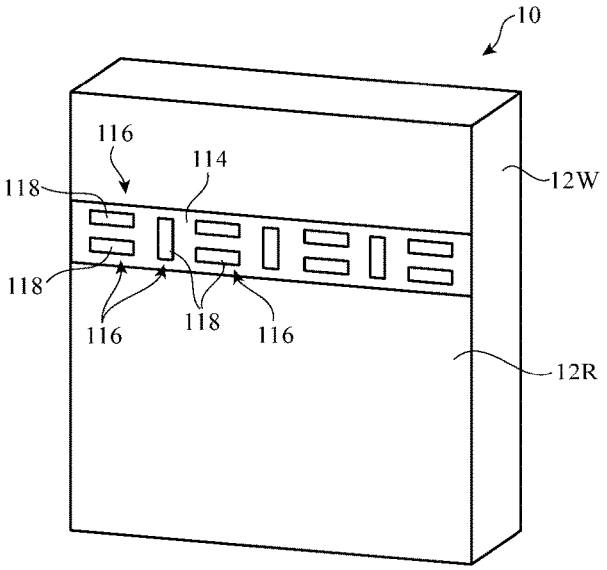
FIG. 20 is a perspective view of an illustrative electronic device having a metal housing with a dielectric slot and having an array of slot antennas aligned with the dielectric slot in accordance with an embodiment.
Figure 21:
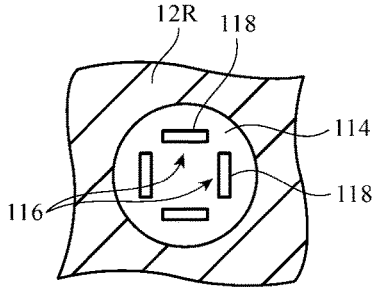
FIG. 21 is a top view of an illustrative dielectric window in a metal housing in which an array of antennas such as an array of slot antennas has been mounted in accordance with an embodiment.

FIG. 20 is a perspective view of an illustrative electronic device in which metal housing 12 has rear wall 12R and sidewalls 12W. Millimeter wave antenna window 114 extends across rear housing wall 12R. Antenna window 114 overlaps an array of slot antennas 116. Slot antennas 16 may have one more different orientations (e.g., orthogonal orientations). For example, antennas 16 may include horizontal and vertical slots 118 to provide the array of antennas with antennas 16 of two different orthogonal polarizations. In the example of FIG. 21, a logo-shaped millimeter wave antenna window 114 overlaps slot antennas 116 with two different orthogonal polarizations.

Figure 22:
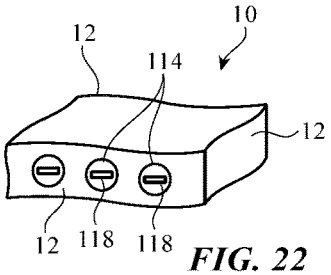
FIG. 22 is a perspective view of a portion of an electronic device with openings such as speaker holes or other air-filled audio port openings in which slot antennas have been mounted in accordance with an embodiment.

FIG. 22 shows how antenna windows 114 may be formed using openings in metal housing 12 (e.g., air-filled audio port openings, air-filled connector port openings, etc.). One or more slot antennas 116 may be aligned with each opening 114. Openings 114 may be formed on the upper surface of the base housing in a laptop computer, along the lower edge of a cellular telephone, or on any other portion of housing 12 in an electronic device.

Figure 23:
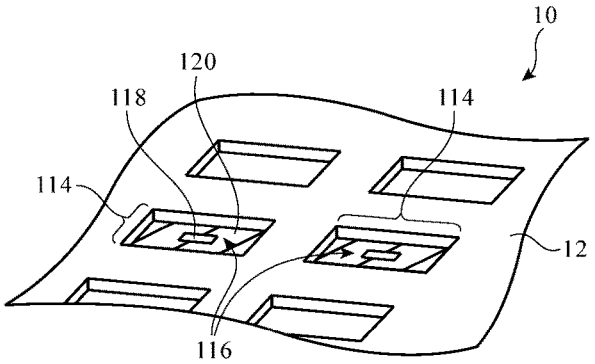
FIG. 23 is a perspective view of a portion of a metal device housing that has been provided with an array of openings and associated slot antennas in accordance with an embodiment.
Figure 24:
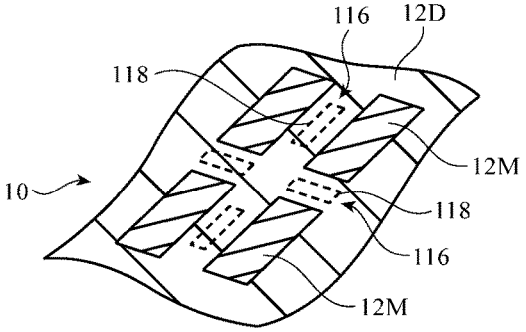
FIG. 24 is a perspective view of a portion of a metal electronic device housing with an array of metal structures in a grid of dielectric that can accommodate antennas in accordance with an embodiment.
Figure 25:
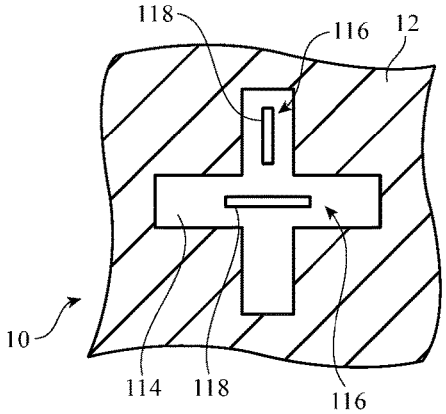
FIG. 25 is a top view of an illustrative cross-shaped dielectric region in a metal housing that may be used to accommodate a millimeter wave antenna in accordance with an embodiment.

FIG. 23 is a perspective view of a portion of metal housing 12. In the example of FIG. 23, housing 12 has an array of openings including millimeter wave antenna window openings such as antenna windows 114 that overlap slot antennas 116. If desired, housing 12 may have conductive islands supported by plastic or other dielectric. As shown in FIG. 24, for example, housing 12 may have metal structures (pads) 12M that are supported by a grid of dielectric (e.g., plastic 12D). Slot antennas 116 may be overlapped by dielectric portions 12D (i.e., the dielectric in the gaps between respective pads 12M). FIG. 25 shows how millimeter wave antenna windows 114 may have cross shapes. In the example of FIG. 25, window 114 has vertical and horizontal portions each of which contains a slot antenna 116. Slots 118 of slot antennas 116 in FIG. 25 have longitudinal axes that are orthogonal to each other to enhance antenna polarization diversity.

Figure 26:
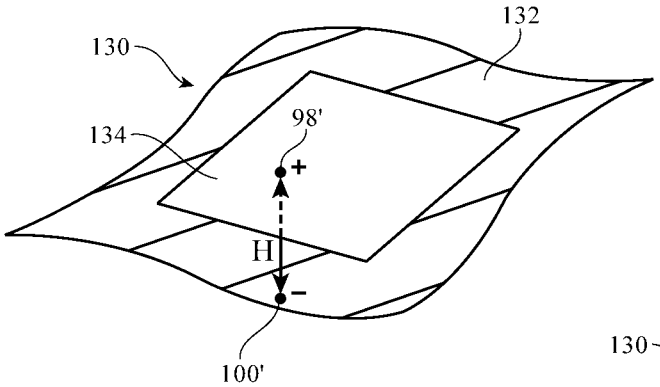
FIG. 26 is a perspective view of an illustrative patch antenna in accordance with an embodiment.
Figure 27:
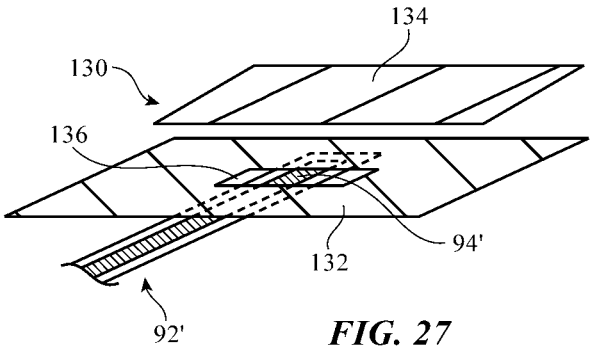
FIG. 27 is a perspective view of an illustrative patch antenna with a coupled feed in accordance with an embodiment.
Figure 28:
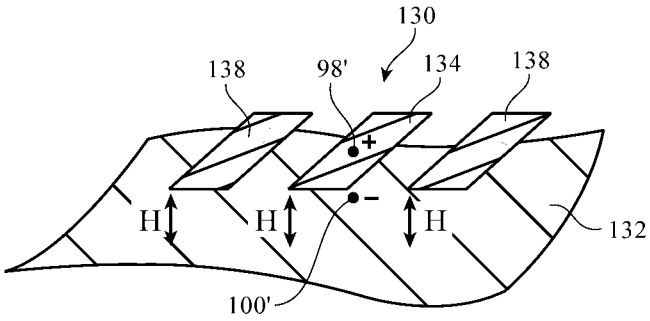
FIG. 28 is a perspective view of an illustrative patch antenna with parasitic patch elements in accordance with an embodiment.
Figure 29:
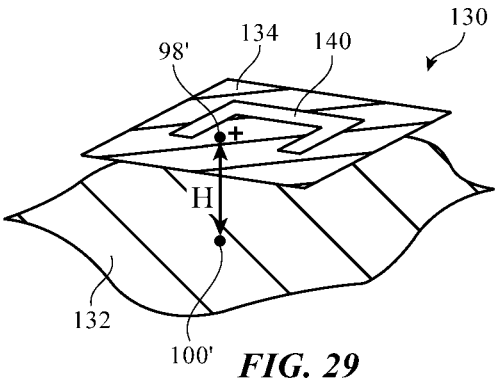
FIG. 29 is a perspective view of an illustrative patch antenna that includes an elongated opening in accordance with an embodiment.
Figure 30:
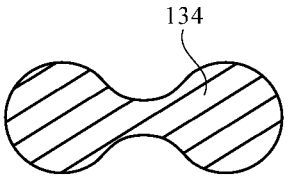
FIG. 30 is a top view of an illustrative patch resonating element in accordance with an embodiment.
Figure 31:
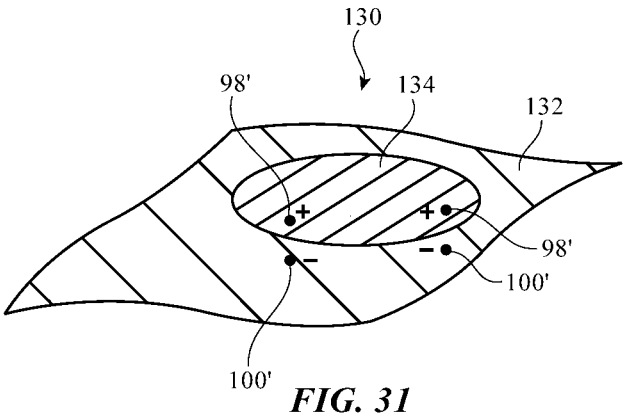
FIG. 31 is a perspective view of an illustrative patch antenna having multiple feeds in accordance with an embodiment.

If desired, millimeter wave antennas for device 10 may be formed using patch antenna resonating elements. An illustrative patch antenna is shown in FIG. 26. Patch antenna 130 of FIG. 26 has ground 132 and patch antenna resonating element 134. Patch antenna resonating element 134 may be separate by a distance H from ground 132. Patch element 134 may be a planar metal structure and ground 132 may be a parallel planar metal structure. Antenna 130 may be fed using feed terminals 98' and 100'. FIG. 27 shows how patch antenna 130 may be fed using a coupled feed arrangement (e.g., an arrangement in which positive signal line 94' of transmission line 92' overlaps opening 136 in ground plane 132 at a location that is overlapped by patch antenna resonating element 134). As shown in FIG. 28, patch antenna 130 may have parasitic patch elements such as parasitic patches 138 to enhance the bandwidth of antenna 130. FIG. 29 shows how patch resonating element 134 may contain one or more openings such as slot 140 to alter the flow of current in element 134 and thereby optimize antenna performance. If desired, patch antennas may have non-square shapes. As shown in FIG. 30, for example, element 134 may have a shape with enlarged ends. Other suitable shapes (ovals, circles, squares, rectangles, triangles, other shapes with curved edges, other shapes with straight edges, shapes with combinations of curved and straight edges, and other shapes may be used, if desired. As shown in FIG. 31, a patch antenna may have multiple feeds (e.g. to broaden bandwidth and/or to introduce multiple polarizations).

Figure 32:
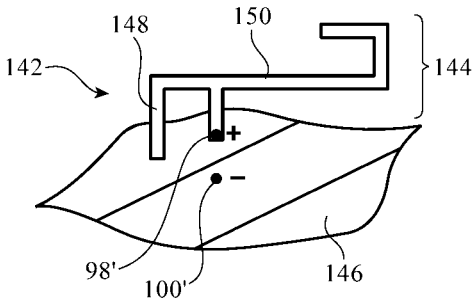
FIG. 32 is a perspective view of an illustrative inverted-F antenna in accordance with an embodiment.

If desired, millimeter wave antennas in device 10 may be inverted-F antennas. Illustrative inverted-F antenna 142 of FIG. 32 has an inverted-F antenna resonating element 144 and antenna ground plane 146. Antenna 142 of FIG. 32 may be fed using positive antenna feed terminal 98' and ground antenna feed terminal 100. Resonating element 144 may include a main resonating element arm such as arm 150 with one or more branches. Arm 150 may be straight or may, as shown in FIG. 32, have a meandering shape. Return path 148 may couple arm 150 to ground in parallel with the antenna feed of antenna 142.

Figure 33:
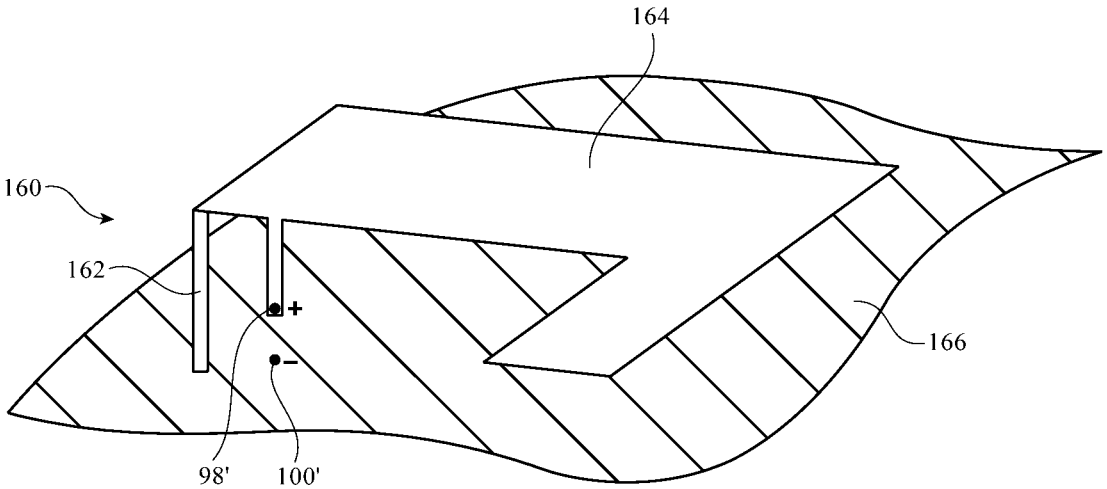
FIG. 33 is a perspective view of an illustrative planar inverted-F antenna in accordance with an embodiment.

FIG. 33 shows how millimeter wave antennas in device 10 may be formed from planar inverted-F antenna structures. Planar inverted-F antenna 160 has a planar inverted-F antenna resonating element (element 164) that is coupled to ground plane 166 by return path 162. Antenna 160 is fed at terminals 98' and 100 in parallel with return path 162.

Figure 34:
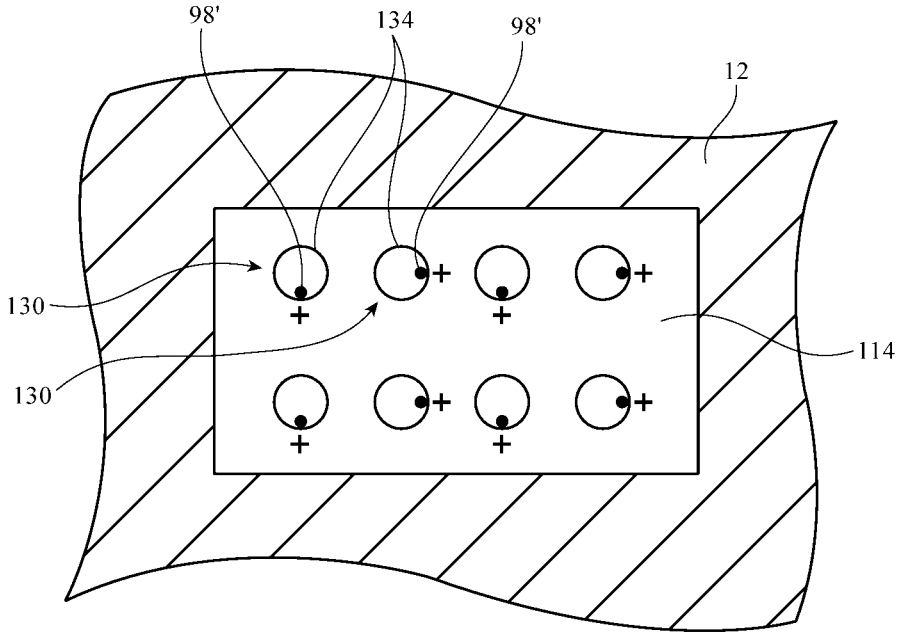
FIG. 34 is a perspective view of an array of illustrative patch antennas in a dielectric window in a metal electronic device housing in accordance with an embodiment.

As shown in FIG. 34, an array of two or more millimeter wave patch antennas such as antennas 130 may be mounted in alignment with millimeter wave antenna window 114. The locations of the antenna feeds for patch resonating elements 134 of antennas 130 may be different for different antennas so that different antennas 130 exhibit different polarizations. As an example, half of antennas 130 may be polarized in one direction and the other half of antennas 130 may be polarized in an orthogonal direction. This type of arrangement may be used for slot antennas, dipole antennas, or other millimeter wave antennas.

Figure 35:
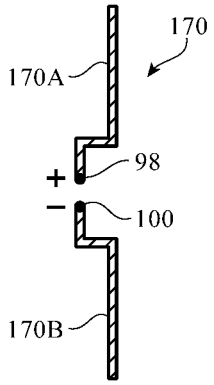
FIGS. 35, 36, 37, 38, 39, and 40 show illustrative dipole-type antenna structures in accordance with an embodiment.
Figure 36:
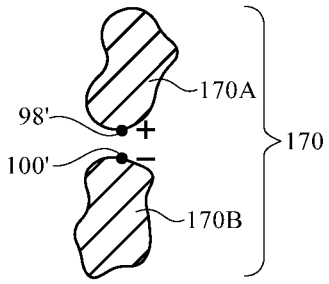
Figure 37:
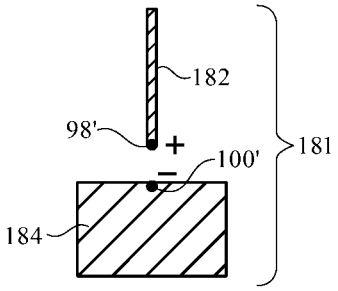

FIGS. 35, 36, 37, 38, 39, and 40 show illustrative dipole-type antenna structures that may be used in implementing millimeter wave antennas in device 10. As shown in FIG. 35, dipole antenna 170 may have a pair of equal length arms such as arms 170A and 170B. FIG. 36 shows how the arms of antenna 170 may be formed from patches of conductive material (e.g., to enhance antenna bandwidth). FIG. 37 is a diagram of an illustrative monopole antenna. As shown in FIG. 37, monopole antenna 181 may include an arm that extends outwardly from ground plane 184 such as arm 182.

Figure 38:
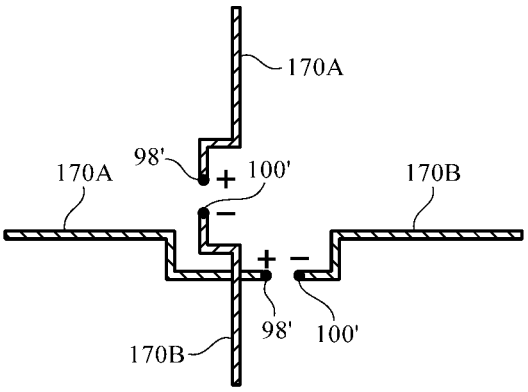
Figure 39:
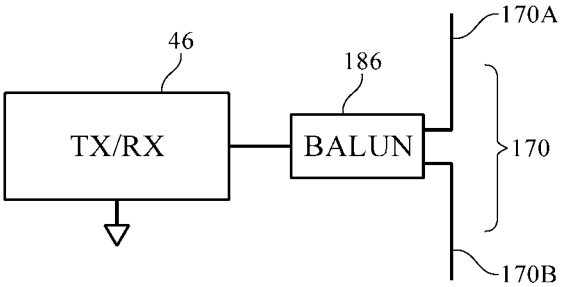
Figure 40:
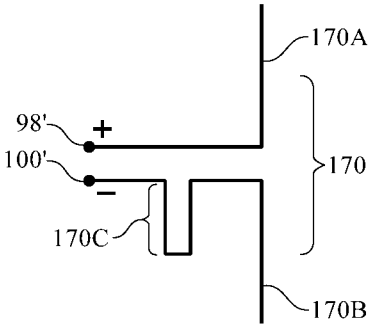

If desired, a pair of dipole antennas may be oriented so that the arms of each antenna extend orthogonally with respect to each other (FIG. 38). This provides polarization diversity. FIG. 39 shows how a single-ended radio-frequency transceiver (illustrative transceiver 46) may be coupled to dipole antenna 170 using balun 186. If desired, dipole antenna 170 may include a structure such as path length difference structure 170C of FIG. 40 that imparts a desired phase delay into one of the arms of the dipole (e.g., to arm 170B in the illustrative example of FIG. 40). As one example, path length difference structure 170C may impart a quarter wavelength path length distance so that arms 170A and 170B are 90° out of phase.

Figure 41:
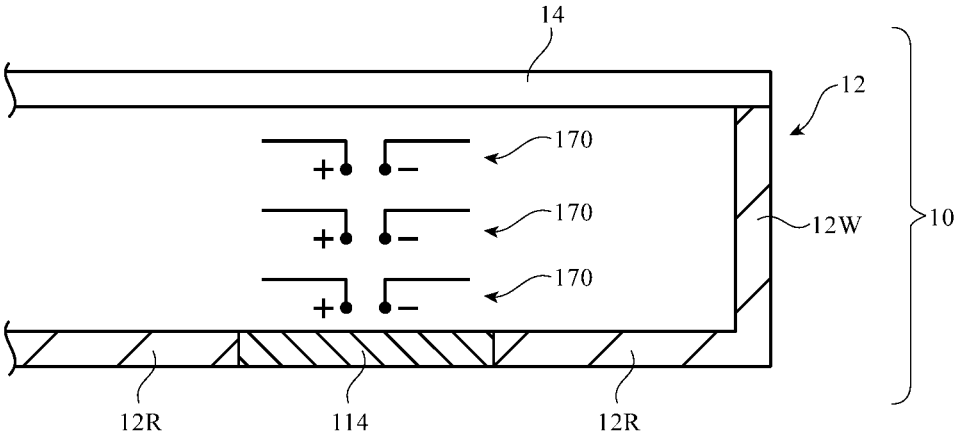
FIG. 41 is a cross-sectional side view of an illustrative array of dipole antennas aligned with a dielectric opening such as a slot in a metal electronic device housing in accordance with an embodiment.

FIG. 41 is a cross-sectional side view of a portion of device 10 in which millimeter wave antenna window 114 has the shape of a slot that extends into the page. Window 114 may, for example, be a plastic-filled opening in rear metal housing wall 12R. As shown in FIG. 41, a set of one or more dipole antennas 170 may be stacked one above the next in alignment with antenna window 114. If desired, the arms of dipole antennas 170 may extend parallel to slot 114. The configuration of FIG. 41 is merely illustrative. If desired, some of the antenna signals associated with dipole antennas 170 (or other millimeter wave antennas such a patch or dipole antennas) may pass through portions of display 14 (e.g., portions of a display cover glass in an inactive area of display 14 that is relatively devoid of conductive structures).

Figure 42:
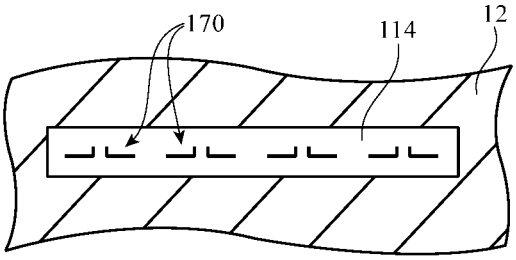
FIGS. 42, 43, 44, and 45 are diagrams of illustrative dielectric openings in metal electronic device housings of the type that may accommodate millimeter wave antennas in accordance with embodiments.
Figure 43:
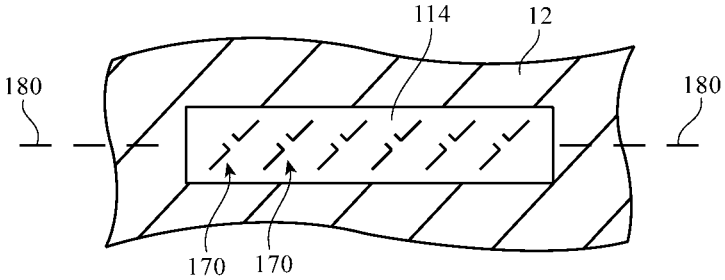
Figure 44:
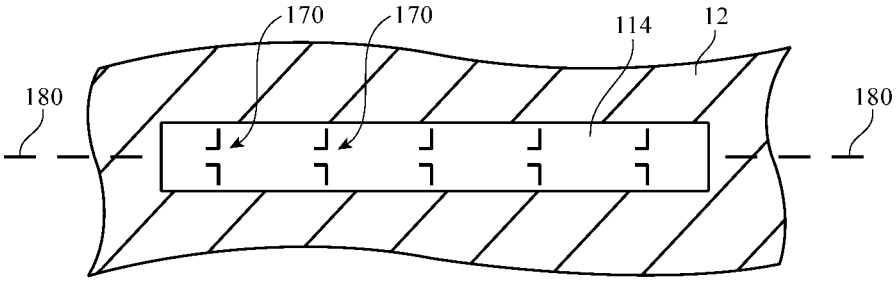

FIG. 42 shows how dipole antennas 170 may be formed with arms that extend parallel to a slot-shaped millimeter wave antenna window in housing 12 (i.e., antenna window 114). In the example of FIG. 43, dipole antennas 170 are angled at a non-zero angle (e.g., 45° or other angle between 0 and 90°) with respect to longitudinal axis 180 of antenna window 114. In the example of FIG. 44, dipole antennas 170 have arms that extend along a dimension that is perpendicular to axis 180. Configurations with mixtures of the dipole antenna configurations of FIGS. 42, 43, and 44 may also be used.

Figure 45:
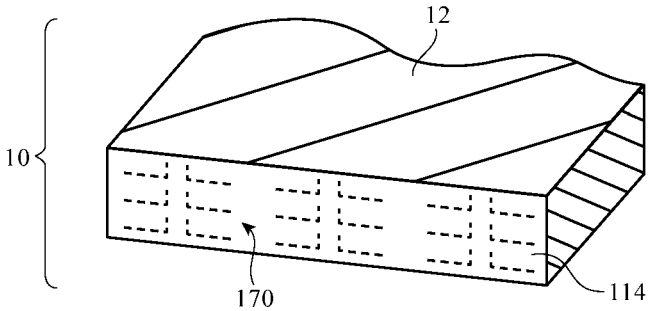

As shown in the illustrative end view of device 10 of FIG. 45, antenna window 114 may be formed along an edge of device 10 (e.g., the lower or upper sidewall or the left or right sidewall of a rectangular device, etc.). Antennas 170 may be formed in an array and may have arms that extend along the length of window 114 or that are positioned in window 114 in other orientations.

In general, antenna window 114 may be solid or filled with air. Window 114 may have the shape of a logo or other shape. Window 114 may form part of a dielectric structure in a larger (non-millimeter-wave) antenna such as a cellular telephone and/or wireless local area network antenna as well as serving as a window for one or more millimeter wave antennas. Millimeter wave antennas may be inverted-F antennas, planar inverted-F antennas, patch antennas, dipole antennas, monopole antennas, slot antennas, or other suitable antennas. The millimeter wave antennas may be formed under one or more windows 114 and may have multiple different orientations (e.g., multiple different polarizations). The millimeter wave antennas may be formed in horizontal lines, vertical stacks, two-dimensional arrays, or other suitable patterns.

The foregoing is merely illustrative and various modifications can be made by those skilled in the art without departing from the scope and spirit of the described embodiments. The foregoing embodiments may be implemented individually or in any combination.

What is claimed is:

1. An electronic device having opposing first and second surfaces, comprising:

a housing having a housing wall that forms the first surface;

a display mounted to the housing and having a display cover layer that forms the second surface;

a millimeter wave antenna mounted within the housing, wherein the millimeter wave antenna comprises a ground plane, a slot in the ground plane, and a resonating element that overlaps the slot in the ground plane and the millimeter wave antenna conveys signals through the display cover layer;

millimeter wave transceiver circuitry in the housing and configured to convey radio-frequency signals at a frequency between 10 GHz and 400 GHz; and a radio-frequency transmission line that couples the millimeter wave transceiver circuitry to the millimeter wave antenna, wherein the radio-frequency transmission line comprises a ground signal conductor and a positive signal conductor that overlaps the slot in the ground plane, wherein the ground plane is interposed between the positive signal conductor and the resonating element.

2. The electronic device defined in claim 1, wherein the resonating element has a rectangular periphery.

3. The electronic device defined in claim 1, wherein the slot in the ground plane extends along a first axis and a portion of the positive signal conductor that overlaps the slot extends along a second axis that is perpendicular to the first axis.

4. The electronic device defined in claim 1, wherein the ground signal conductor is shorted to the ground plane.

5. The electronic device defined in claim 1, wherein the display cover layer comprises a transparent material selected from the group consisting of: glass, plastic, and sapphire.

6. An electronic device having front and rear surfaces, comprising:

a housing having a rear wall that forms the rear surface;

a display mounted in the housing;

a display cover layer that covers the display and that forms the front surface; and a millimeter wave antenna that conveys millimeter wave signals through the display cover layer, wherein the millimeter wave antenna includes a slot in a ground plane, the millimeter wave antenna is fed using a coupled feed arrangement in which a portion of a transmission line conductor overlaps the slot in the ground plane and feeds the millimeter wave antenna through the slot in the ground plane, and the portion of the transmission line conductor that overlaps the slot in the ground plane is orthogonal to an axis of the slot in the ground plane.

7. The electronic device defined in claim 6, further comprising:

transceiver circuitry in the housing that is configured to convey the millimeter wave signals at a frequency between 10 GHz and 400 GHz using the millimeter wave antenna.

8. The electronic device defined in claim 6, wherein the display cover layer comprises a layer selected from the group consisting of: a transparent glass layer, a transparent plastic layer, and a transparent sapphire layer.

9. The electronic device defined in claim 6, wherein the millimeter wave antenna further comprises a rectangular resonating element that overlaps the slot in the ground plane and the portion of the transmission line conductor that overlaps the slot.

* * * * *